US011564473B2

(12) United States Patent
Mahmood

(10) Patent No.: US 11,564,473 B2
(45) Date of Patent: Jan. 31, 2023

(54) SELF-INKING EYELINER PEN AND STAMP

(71) Applicant: Malik Yasir Mahmood, Christchurch (NZ)

(72) Inventor: Malik Yasir Mahmood, Christchurch (NZ)

( * ) Notice: Subject to any disclaimer, the term of this patent is extended or adjusted under 35 U.S.C. 154(b) by 0 days.

(21) Appl. No.: 16/997,537

(22) Filed: Aug. 19, 2020

(65) Prior Publication Data

US 2020/0375341 A1 Dec. 3, 2020

Related U.S. Application Data

(63) Continuation of application No. 15/940,168, filed on Mar. 29, 2018, now Pat. No. 10,786,062.

(51) Int. Cl.

| | |
|---|---|
| ***A47L 1/08*** | (2006.01) |
| ***A45D 34/04*** | (2006.01) |
| ***A45D 40/20*** | (2006.01) |
| ***A45D 40/24*** | (2006.01) |
| ***A45D 40/26*** | (2006.01) |
| ***A45D 34/06*** | (2006.01) |

(52) U.S. Cl.

CPC ..... *A45D 34/04* (2013.01); *A45D 34/06* (2013.01); *A45D 40/20* (2013.01); *A45D 40/24* (2013.01); *A45D 40/26* (2013.01); *A45D 2200/1045* (2013.01); *A45D 2200/1072* (2013.01)

(58) Field of Classification Search

CPC ..... A45D 34/04; A45D 34/06; A45D 40/18; A45D 40/20; A45D 40/24; A45D 40/26

USPC ..... 401/17

See application file for complete search history.

(56) References Cited

U.S. PATENT DOCUMENTS

| | | | | |
|---|---|---|---|---|
| 3,343,552 | A | 9/1967 | Steffan | |
| 3,678,947 | A | 7/1972 | Ehrlich | |
| 4,792,252 | A | 12/1988 | Kremer et al. | |
| 6,474,887 | B2 * | 11/2002 | Ozu | B43K 5/00 401/196 |
| D585,489 | S | 1/2009 | Han | |
| D656,545 | S | 3/2012 | Hung | |
| D683,071 | S | 5/2013 | Lorenz | |
| D707,393 | S | 6/2014 | Lorenz | |
| 9,554,635 | B1 | 1/2017 | Liu | |
| D780,994 | S | 3/2017 | Hardwick | |
| 9,635,924 | B1 | 5/2017 | Herrera | |
| D837,297 | S | 1/2019 | Muori | |
| D859,737 | S | 9/2019 | Lorenz et al. | |

(Continued)

FOREIGN PATENT DOCUMENTS

| | | | |
|---|---|---|---|
| CN | 204561273 | U | 3/2015 |
| CN | 304905582 | S | 11/2018 |

(Continued)

OTHER PUBLICATIONS

One-Second Winged Eyeliner . . . OMG; YouTube video; https://www.youtube.com/watch?v=wFEq99F9oOw&ab_channel=Tati; Jun. 13, 2017.

(Continued)

*Primary Examiner* — Jennifer C Chiang

(74) *Attorney, Agent, or Firm* — Brooks Kushman P.C.

(57) ABSTRACT

A cosmetic applicator body including a cylindrical hollow body configured to contain a volume of cosmetic material, a first nib roller cooperatively engaged at a first end, and a second nib holder cooperatively engaged at a second end.

4 Claims, 8 Drawing Sheets

(56) References Cited

U.S. PATENT DOCUMENTS

| | | | |
|---|---|---|---|
| D862,797 | S | 10/2019 | Smith |
| 10,966,503 | B1 | 4/2021 | Robinson et al. |
| 2006/0204318 | A1 | 9/2006 | Kwon |
| 2007/0251542 | A1 | 11/2007 | Tajima |
| 2008/0063463 | A1 | 3/2008 | Hori |
| 2009/0317432 | A1 | 12/2009 | Kergosien |
| 2017/0156474 | A1 | 6/2017 | Djarar Fischer et al. |
| 2017/0231363 | A1 | 8/2017 | Herrera |
| 2019/0298032 | A1 | 10/2019 | Mahmood |

FOREIGN PATENT DOCUMENTS

| | | | |
|---|---|---|---|
| DE | 402016201878 | | 6/2017 |
| DE | 402016201878-0001 | | 6/2017 |
| DE | 402016201878-0002 | | 6/2017 |
| DE | 402016201878-0003 | | 6/2017 |
| EP | 1105012 | B1 | 7/2002 |
| WO | 2018141014 | A1 | 8/2018 |
| WO | 2019028498 | A1 | 2/2019 |

OTHER PUBLICATIONS

Lovoir; The Flick Stick; hllps://www.lovoir.com/producls/eyeliner-slamp-10mm; 6 pages.

The Quick Flick; https://lhequickflick.com.au/producls/inlense-black; 25 pages.

Cleopatra Cat Eye Stamp by Lyda Beauty. (n.d.) Retrieved Mar. 28, 2018, https://lydabeauty.com/.

Perfect Winged Eyeliner Stamp?! Does It Work!? (Viewed Aug. 24, 2018) (available at https://www.youtube.com/watch?v=ooCLY_LP9sY>).

* cited by examiner

SELF-INKING EYELINER PEN AND STAMP

CROSS-REFERENCE TO RELATED APPLICATION

This application is a continuation of U.S. application Ser. No. 15/940,168 filed Mar. 29, 2018 and issued on Sep. 29, 2020 as U.S. Pat. No. 10,786,062, the disclosure of which is incorporated herein by reference in its entirety.

TECHNICAL FIELD

The present invention relates to cosmetics, and more particularly to cosmetics for the eyes, such as eyeliners.

BACKGROUND

In applying cosmetic products to the eyes, many people find it difficult to get a symmetrical geometric shape, such as a 'flick/wing' at the end of their eyes using a conventional eyeliner. Other eyeliner devices use a single geometric shaped stamp, such as a triangle at the end of a pen shaped device. The user them must dip the geometrically shaped end into a separate container of an ink cosmetic material and then apply the cosmetic material by stamping it on the desired location around the periphery of the eye. Using conventional products is inconvenient and potentially messy operation.

As can be seen, there is a need for an apparatus and method for symmetrically applying an eye cosmetic product to their eyes, while avoiding the inconvenience of a dipping operation.

SUMMARY

In one aspect of the present invention a cosmetic applicator pen includes a cylindrical hollow body. A reservoir is carried within the cylindrical hollow body with the reservoir configured to contain a volume of a cosmetic material. A nib holder is cooperatively engaged at each of a first end and a second end of the cylindrical hollow body. An applicator nib is carried within the nib holder and is configured to apply the cosmetic material from within the reservoir to a skin surface. The cosmetic applicator pen may also have a volume of a cosmetic material contained within the reservoir.

In some embodiments, a first applicator nib formed as a pointed nib at the first end of the pen. A second applicator nib has a hollow cylindrical shaft at a proximal end that is in communication with the reservoir and a stamp pad disposed on a distal end of the hollow cylindrical shaft, wherein the stamp pad is formed as a selected geometric shape. The stamp pad is formed as a uniform shape. Alternatively, the stamp pad is formed as a symmetric shape.

In other embodiments, a first applicator nib has a hollow cylindrical shaft at a proximal end that is configured for fluid communication with the reservoir through the first nib holder. A second applicator nib, also having a hollow cylindrical shaft at a proximal end that is configured for fluid communication with the reservoir through the second nib holder. A first stamp pad is disposed on a distal end of the hollow cylindrical shaft of the first applicator nib and a second stamp pad is disposed on a distal end of the hollow cylindrical shaft of the second applicator nib. The first stamp pad and the second stamp pad may be formed as a mirror image of a selected geometric shape.

The cosmetic applicator pen may also include an end cap fitted to cover the applicator nib for each of the first end and the second end of the applicator pen. In preferred embodiments, the applicator nib is replaceably coupled to the nib holder.

In other aspects of the invention, a cosmetic applicator pen, includes a cylindrical hollow body carrying a reservoir configured to contain a volume of a cosmetic material. A nib holder is cooperatively engaged at opposed ends of the cylindrical hollow body. An applicator nib is carried within the nib holder, wherein the applicator nib is configured to apply the cosmetic material from within the reservoir to an applicator pad disposed on a distal end of the applicator nib. The applicator nib may be replaceable. The cosmetic applicator pen may include an applicator nib that includes a symmetric applicator pad disposed on the opposed sides of the cosmetic applicator pen.

In one embodiment, a cosmetic applicator body is disclosed. The cosmetic applicator body includes a cylindrical hollow body configured to contain a volume of cosmetic material, a first nib roller cooperatively engaged at a first end, and a second nib holder cooperatively engaged at a second end.

These and other features, aspects and advantages of the present invention will become better understood with reference to the following drawings, description and claims.

DETAILED DESCRIPTION

Figure 1:
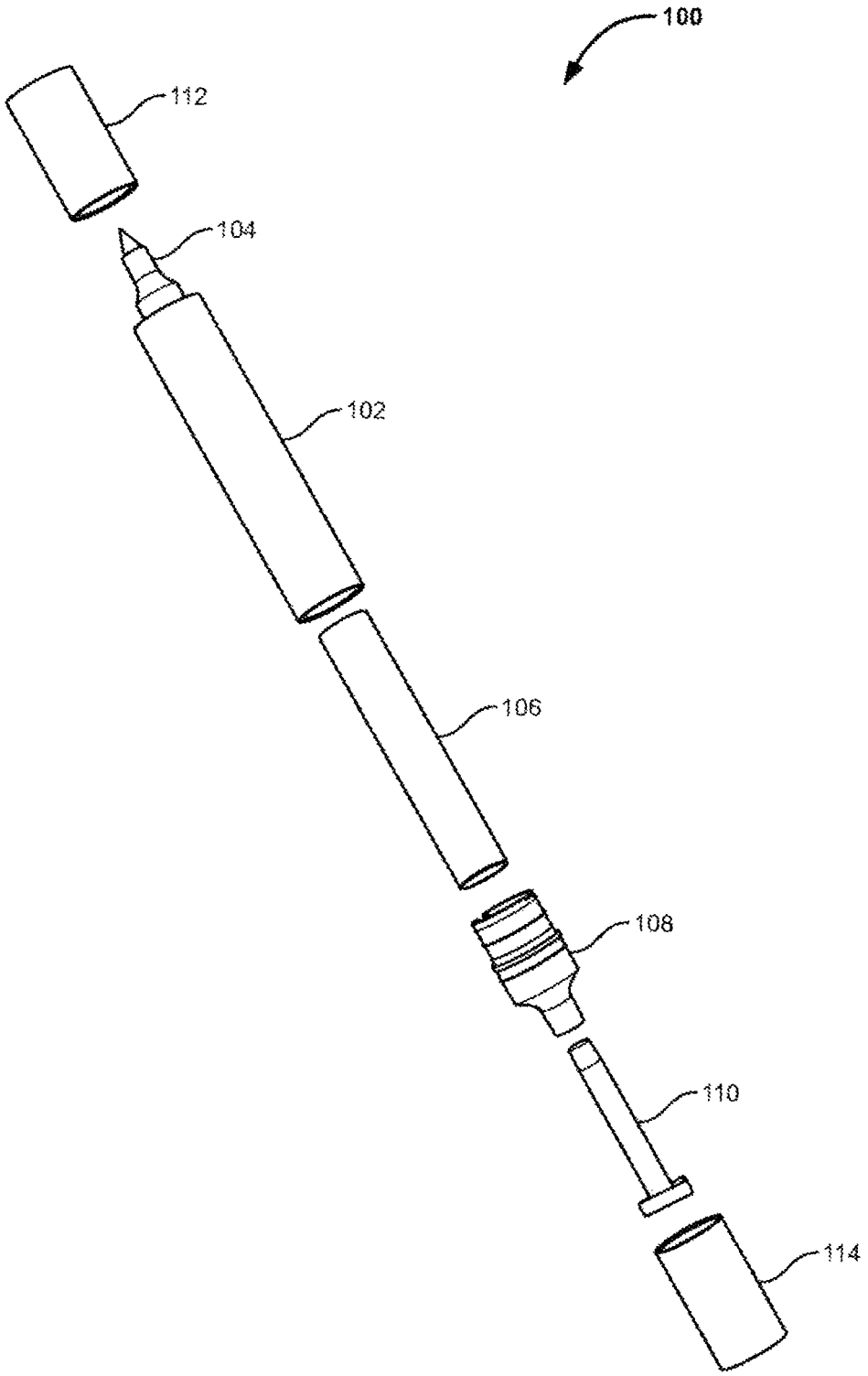
FIG. 1 is a partially exploded side elevation view of a self-inking eyeliner stamp pen.
Figure 2A:
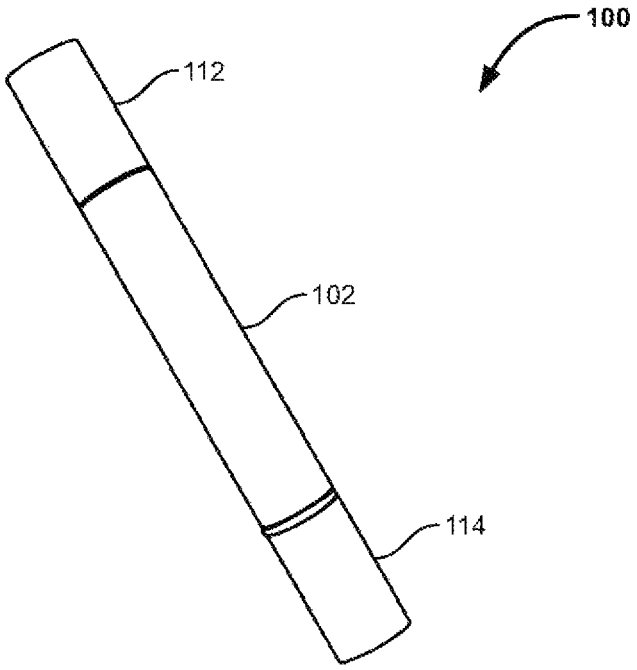
FIG. 2A is a side elevation view of the self-inking eyeliner stamp pen shown in a stowed condition.
Figure 2B:
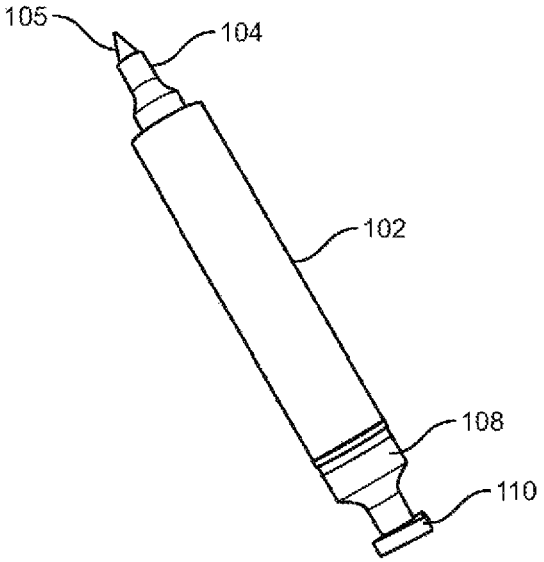
FIG. 2B is a side elevation view of the self-inking eyeliner stamp pen show in a ready for use condition.
Figure 3:
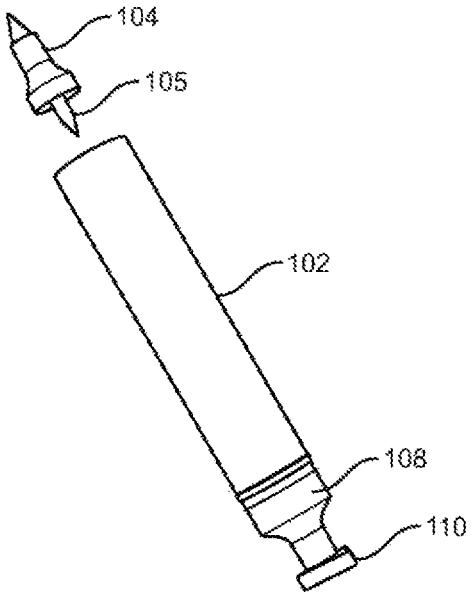
FIG. 3 is a partial exploded side elevation view of the self-inking eyeliner stamp pen.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a self-inking eye cosmetic pen applicator that may be configured with a pointed pen applicator end for precision eyelining and a geometrically shaped stamp applicator end for the application of a shaped cosmetic application to the eye, such as a wing/flick. The pen applicator of the present invention may include changeable applicator ends for a left eye and a right eye. Alternatively, the applicator may be formed as tow applicator pens, one for each of a left and a right eye.

As seen in reference to the drawings of FIGS. 1-8, embodiments of the applicator pen 100 and its components are illustrated. The applicator pen 100 may be formed as a hollow cylindrical body 102. The cylindrical body 102 may carry a first nib holder 104, having a pointed nib 105 that extends from a first end of the cylindrical body 102.

An ink reservoir 106 is carried within the cylindrical body 102 and contains a volume of cosmetic material, such as an ink, that is communicated to and applied with the nib 105 carried in the first nib holder 104.

A second end of the applicator pen 100 includes a second nib holder 108. The second nib holder 108 may have an outwardly extending portion 108*a* configured to extend away from the cylindrical body 102 and an inwardly extending portion 108*b* configured to extend into the cylindrical body 102. In a refinement, the outwardly extending portion 108*a* may include a base portion 108*c* and a curved, tapered portion 108*d* extending therefrom. A collar portion 108*e* may extend from the curved, tapered portion 108*d* such that the stamp pad 110*b* rests on the collar portion 108*e*. The inwardly extending portion 108*b* may include one or more interference fit rings 108*f* to cooperatively engage the cylindrical body 102. The second nib holder 108 may be fitted with a stamp nib 110. The stamp nib 110 may include a shaft 110*a* that communicates the cosmetic material to a stamp pad 110*b* of the stamp nib 110. The stamp pad 110*b* may be formed in a selected geometric shape, such as the 'flick/wing' shape shown in the drawings.

The applicator pen 100 may also include a cap 112 covering the first applicator tip 105 and a second cap 114 to cover the second applicator tip 110 to prevent drying of the cosmetic material carried by the respective tips.

In some embodiments, the stamp pad 110*b* may be of a uniform shape, that is, it may be used to apply a cosmetic material to either a left eye or a right eye with uniform appearance. In other embodiments, such as the 'flick/wing', shown in FIGS. 4A and 4B, the stamp pad 110*b* may be a symmetric form, such that the application of the cosmetic material to a left eye would mirror that of the application of the cosmetic material to a right eye. The stamp pad 110*b* includes a surface covered by a felt or porous material to convey the cosmetic material from within reservoir 106 and through the shaft 110*b* so that the stamp pad 110*b* is self-inking.

Figure 4A:
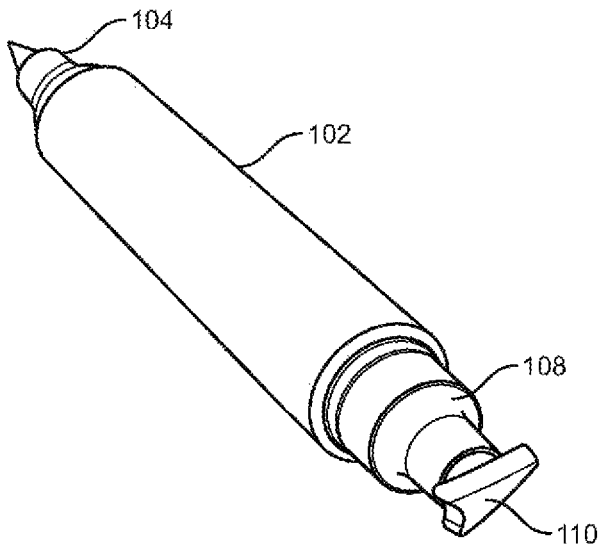
FIG. 4A is a rear perspective view of the self-inking eyeliner stamp pen for a right eye.
Figure 4B:
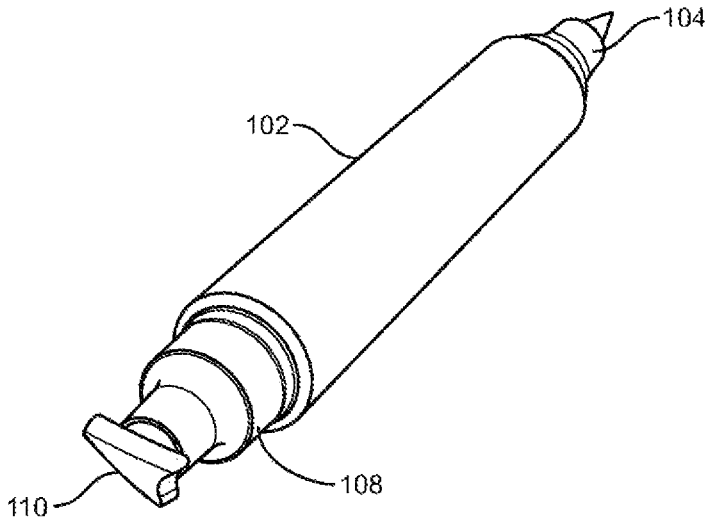
FIG. 4B is a rear perspective view of the self-inking eyeliner stamp pen for a left eye.
Figure 5A:
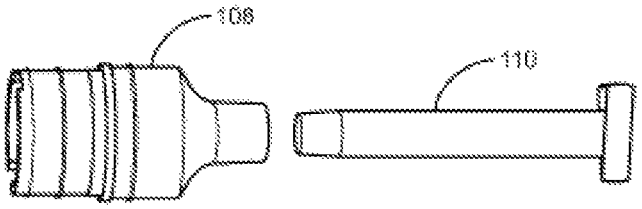
FIG. 5A is an exploded side elevation view of a stamper and nib holder.
Figure 5B:
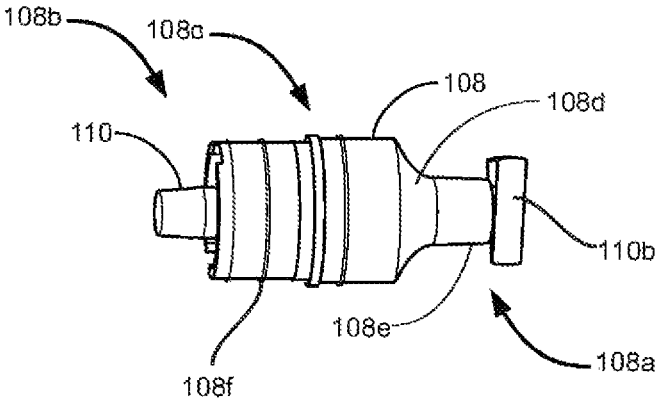
FIG. 5B is an assembled side elevation view of a stamper and nib holder.
Figure 6A:
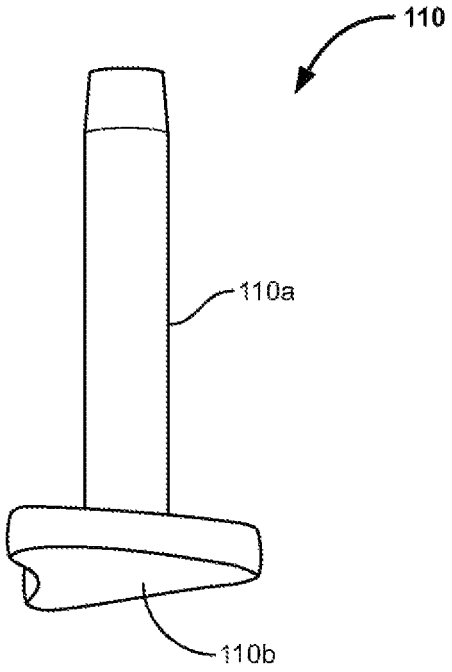
FIG. 6A is a side perspective view of a stamper for a left eye.
Figure 6B:
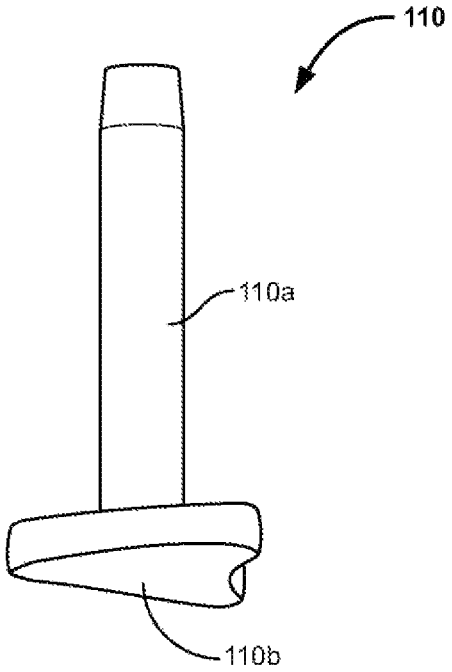
FIG. 6B is a side perspective view of a stamper for a right eye.
Figure 7A:
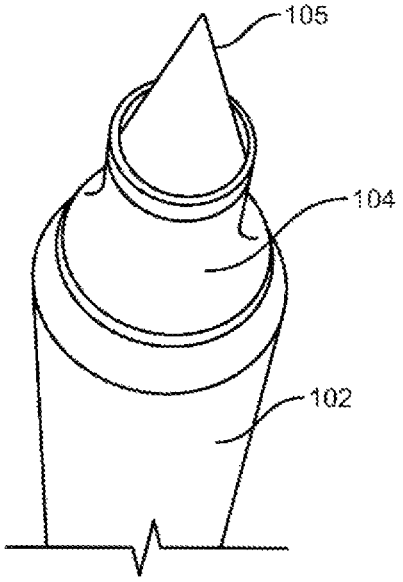
FIG. 7A is a top perspective detail view of an eyeliner pen tip.
Figure 7B:
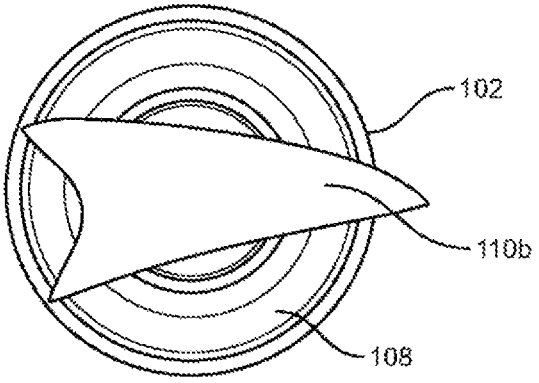
FIG. 7B is a bottom plan view of a stamper end of the self-inking eyeliner stamp pen for a left eye.
Figure 8:
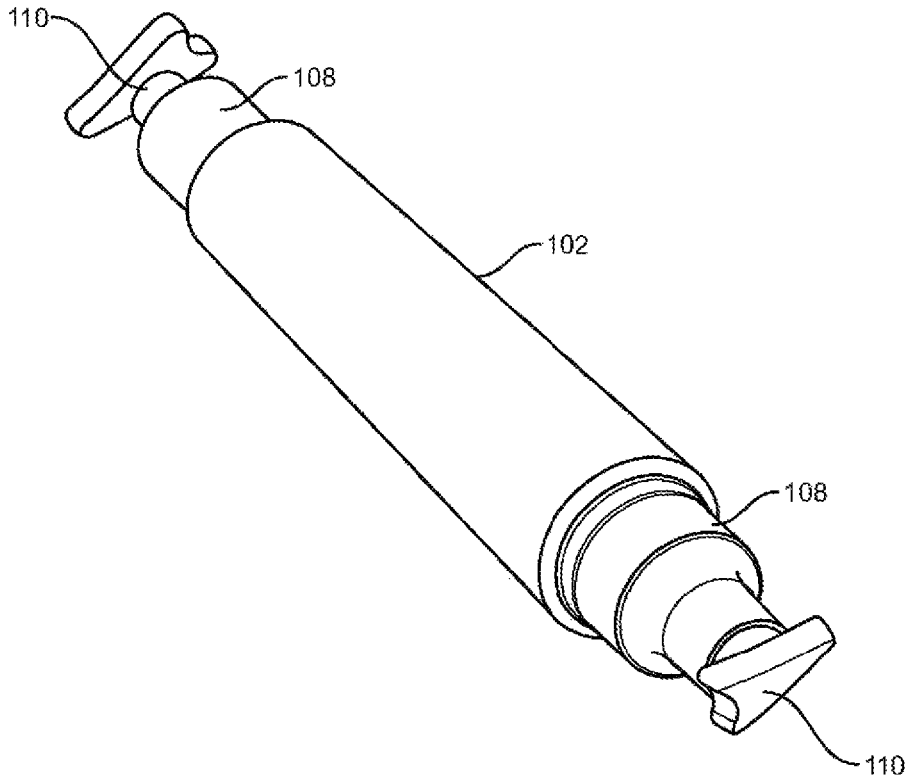
FIG. 8 is a perspective view with a left and a right stamp applied to opposed ends.

As previously indicated, the applicator pen 100 may be provided as a first pen for a left eye and a second pen for a right eye, such as shown in reference to FIGS. 4A and 4B. Alternatively, the applicator pen 100 may be provided with a left and a right applicator stamp 110, such as shown in reference to FIG. 8. In yet other embodiment, the applicator pen 100 may include a plurality of replaceable applicator tips 104, 110, so that the applicator pen 100 may be configured to a user's preference.

It should be understood, of course, that the foregoing relates to exemplary embodiments of the invention and that modifications may be made without departing from the spirit and scope of the invention as set forth in the following claims.

What is claimed is:

1. A cosmetic applicator pen comprising:

a hollow body having first and second ends;

a stamp nib; and a nib holder configured to carry the stamp nib and cooperatively engaged at one of the first or second ends of the hollow body such that an outwardly extending portion of the nib holder extends away from the hollow body and an inwardly extending portion of the nib holder extends into the hollow body, the outwardly extending portion including a base portion, a curved, tapered portion extending from the base portion, and a collar portion extending from the base portion, the base portion sharing a common diameter with the hollow body.

2. The cosmetic applicator pen of claim 1, wherein the inwardly extending portion of the nib holder includes one or more interference fit rings.

3. The cosmetic applicator pen of claim 1, wherein the stamp pad rests on the collar portion.

4. The cosmetic applicator pen of claim 1, wherein the stamp nib has a flick/wing profile.

* * * * *